United States Patent [19]

Tolmer

[11] 4,161,987

[45] Jul. 24, 1979

[54] TRACTOR GRADER

[75] Inventor: Richard G. Tolmer, Norwood, Australia

[73] Assignee: Suzanne G. Tolmer, Norwood, Australia; a part interest

[21] Appl. No.: 850,962

[22] Filed: Nov. 14, 1977

[30] Foreign Application Priority Data

Nov. 15, 1976 [AU] Australia ..... PC8146

[51] Int. Cl.[2] ..... E02F 3/76

[52] U.S. Cl. ..... 172/791; 172/610; 172/796

[58] Field of Search ..... 172/447, 477, 558, 606, 172/610, 667, 673, 742, 781, 789, 791, 792, 793, 795, 796, 797; 37/42 R, 42 VL; 104/35, 37, 44, 45, 46; 108/139, 142; 214/132, 151, 768; 212/66, 67, 69; 248/349; 308/36.5

[56] References Cited

U.S. PATENT DOCUMENTS

| | | | |
|---|---|---|---|
| 160,535 | 3/1875 | McCall et al. | 172/797 X |
| 875,407 | 12/1907 | Bingaman | 172/610 X |
| 928,205 | 7/1909 | Livengood | 172/793 X |
| 2,205,732 | 6/1940 | Royle | 214/132 |
| 3,042,236 | 7/1962 | Pilch | 214/151 |
| 3,131,818 | 5/1964 | Allin, Jr. | 212/69 |
| 3,190,475 | 6/1965 | Fischer | 214/132 |
| 3,721,303 | 3/1973 | Hanser | 172/792 |
| 3,820,609 | 6/1974 | Trott | 172/447 |
| 4,061,194 | 12/1977 | McCanse | 172/447 |
| 4,074,768 | 2/1978 | Stedman | 172/796 |

FOREIGN PATENT DOCUMENTS

| | | | |
|---|---|---|---|
| 503411 | 6/1951 | Belgium | 172/781 |
| 118294 | 4/1958 | U.S.S.R. | 212/67 |

*Primary Examiner*—Richard T. Stouffer

*Attorney, Agent, or Firm*—Kinzer, Plyer, Dorn & McEachran

[57] ABSTRACT

A tractor grader in which the tractor is lengthened by forwardly spacing the front wheels and having a grader blade mounted between the front and rear wheels. The blade is mounted on a lower turntable and supported adjacent an upper turntable plate by rollers engaging the lower turntable and supported by the upper plate of the turntable. The turntable plate is mounted on a frame universally pivoted at its forward end to the elongated chassis and at its rear by a pair of spaced lift rams.

3 Claims, 3 Drawing Figures

TRACTOR GRADER

This invention relates to a tractor grader and more particularly to a means whereby a conventional agricultural tractor could be converted to a grader.

BACKGROUND OF THE INVENTION

Conventional graders are usually constructed to have a relatively long wheel base and are provided with tandem driving wheels at the rear and this construction while being suitable for long straight lengths of run where a long wheel base and a tandem axle assembly minimises the variations in vertical movement applied to the blade from the wheels, these so designed machines are not at all suitable for use in confined areas.

Thus it is an object of this invention to provide a grader which is manoeuvrable and which has sufficient power that digging and ripping and cutting with the grader blade in hard ground can be readily carried out.

DESCRIPTION OF THE INVENTION

Thus there is provided according to the invention a tractor grader, comprising a tractor with an elongated chassis, said grader including a grader blade on a turntable, characterised in that said turntable comprises a lower plate to which the blade is attached, and a cooperating upper plate, said lower plate being supported by a plurality of spaced rollers engaging the lower surface of the lower plate, said rollers being mounted in brackets carried by said upper plate, said upper plate being supported by a frame universally mounted at its forward end to the forward portion of the tractor, and at its rearward end by a plurality of spaced lift rams acting between said turntable and support members fixed to said chassis.

DESCRIPTION OF THE PREFERRED EMBODIMENT

Figure 1:
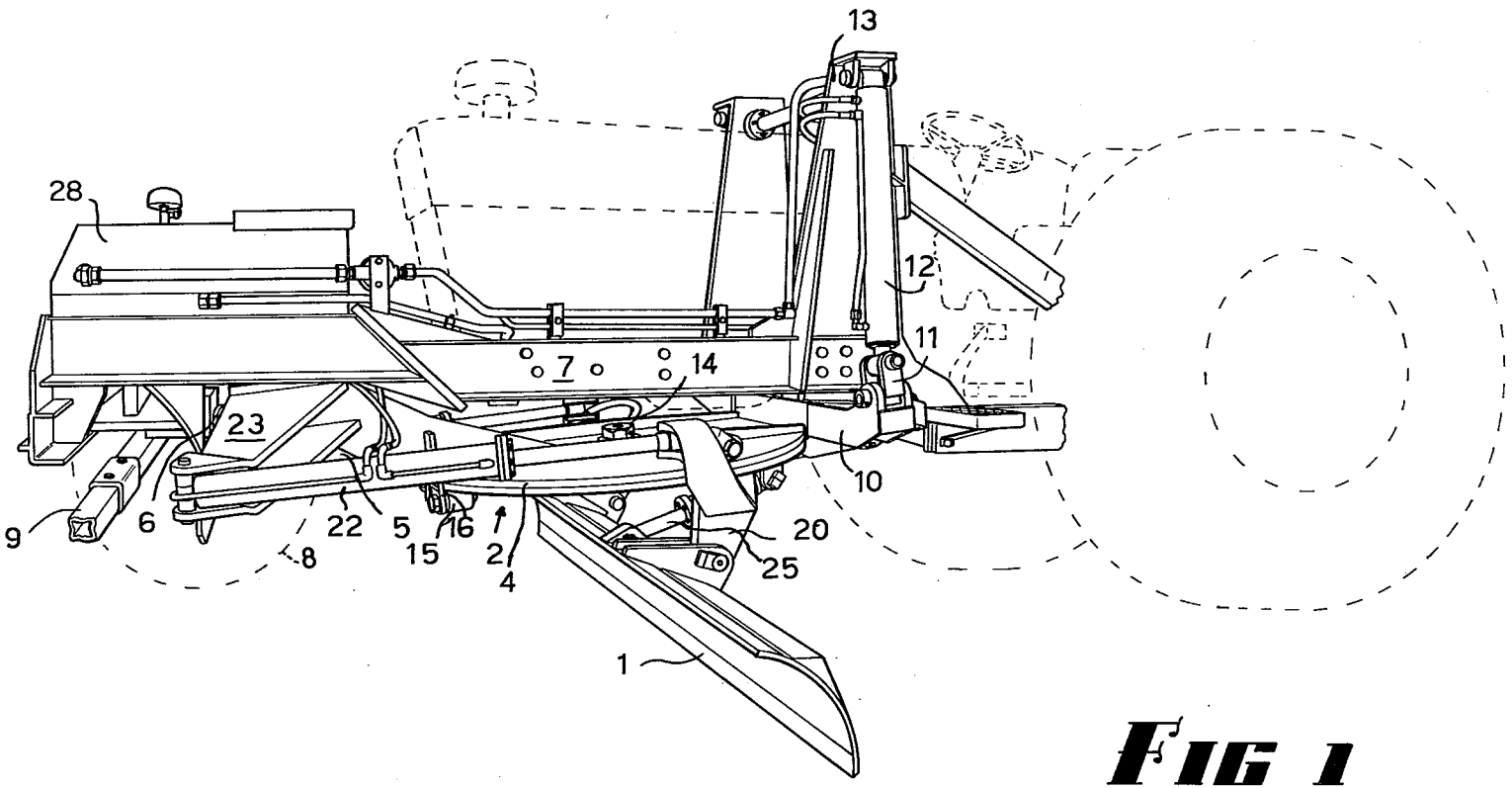
FIG. 1 is a perspective view of the invention, portions being broken away and shown in phantom lines for clarity.
Figure 2:
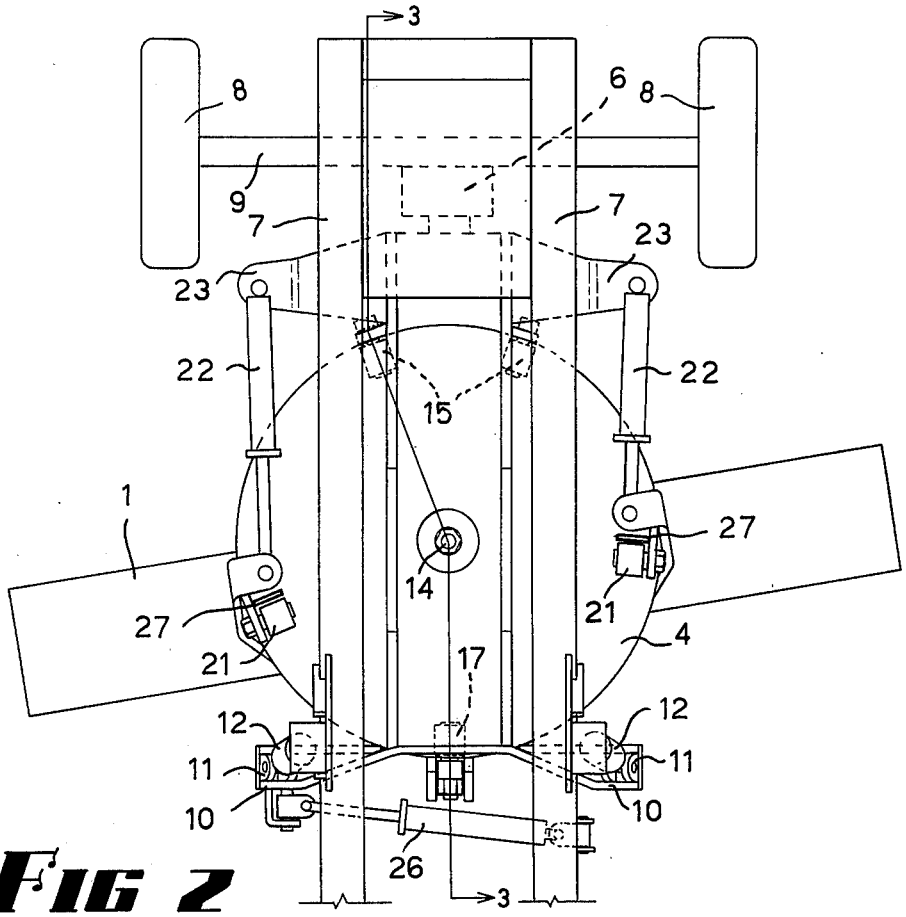
FIG. 2 is a plan view of the invention with portions of the tractor being omitted.
Figure 3:
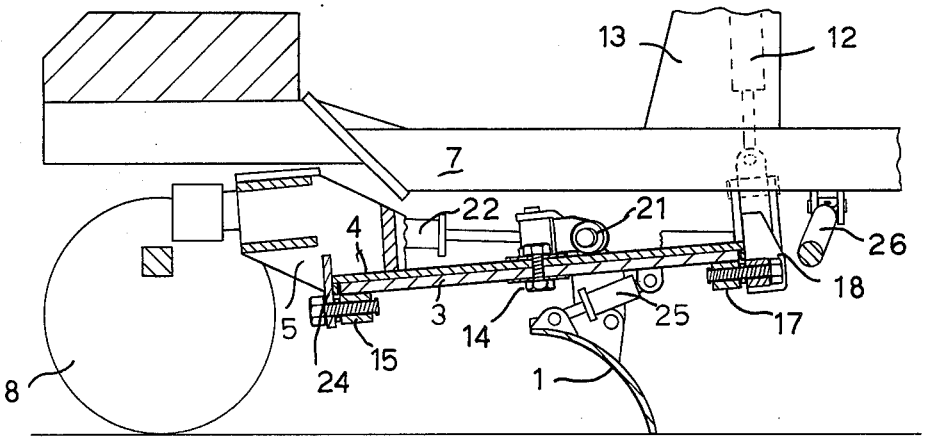
FIG. 3 is a cross-sectional view taken along the lines 3—3 of FIG. 2, portions also being omitted for clarity.

As shown in the drawings the grader blade 1 is mounted on a turntable 2, the turntable 2 comprising two plates with the grader blade 1 being mounted on the lower turntable plate 3 and the upper turntable plate 4 being mounted on a frame 5 which extends forwardly and is mounted by a ball joint in a housing 6 fixed to the main chassis of the tractor.

Preferably the chassis of the tractor is extended forwardly by side beams 7 and the front wheels 8 on axle 9 of the conventional tractor are re-located at the forward end of the extended chassis. The turntable 2 is mounted on the frame 5 which extends from the ball joint rearwardly to underneath the tractor, and supported at its rear by brackets 10 which are attached through universal joints 11 to the lower end of hydraulic lift rams 12, a bracket 10 and a ram 12 being on each side of the tractor. The upper ends of the rams 12 are supported in a supporting framework 13 extending upwardly from the chassis of the tractor, and so the turntable 2 is supported by a three point type of mounting and that by appropriate manipulation of the two supporting hydraulic rams 12 that the turntable can be raised and lowered at its rear end and also inclined to the horizontal.

The lower turntable plate has a vertical pivot pin 14, and is further supported towards the front in relation to the upper turntable plate by a plurality of rollers 15 which are mounted on brackets 16 attached to the upper turntable plate with the rollers 15 extending under the lower turntable plate to support the lower turntable plate 3 in position against the upper turntable plate 4. A further roller 17 is provided centrally at the rear of the turntable 2 and provided on a bracket 18 attached to the frame carrying the brackets 10.

The grader blade 1 is mounted transversely across the lower turntable plate and is also provided at the edges of the plate with large upstanding brackets 20 which extend from the rear of the grader blade up and over the upper edge of the upper turntable plate 4. These brackets support further rollers 21 which are adapted to roll on the top of the upper turntable plate 4 and each of these brackets 20 also pivotally support one end of a hydraulic ram 22, the other ends of the hydraulic rams which extend forwardly being mounted on a cross member 23 attached to the forward end of the frame 5 at the vicinity of the ball joint 6.

These two hydraulic rams 22 are double acting hydraulic rams and can be operated in unison so that when one ram expands the other contracts to thus swivel the grader blade and the angle of the grader blade 1 relative to the forward motion can be thus varied as desired.

Thus it will be seen that by the use of the plurality of rollers, the three rollers 15 and 17 supporting the lower plate 3 and also the two rollers 21 engaging on the upper plate 4 of the turntable adequately support the grader blade and the lower plate of the turntable relative to the upper plate and the rollers thus counteract any twisting or buckling effect on the lower plate due to the load of the grader blade.

Preferably the upper plate 4 has a downwardly extending flange 24 to pass downwardly over the outer edge of the lower plate to protect the lower edge of the plate and to minimise dirt and the like entering in between the two plates.

In conventional manner the grader blade 1 can be provided with tilt rams 25 which act between the grader blade 1 and the supporting brackets 20 attaching the grader blade 1 to the lower plate 3, with the grader blade being pivoted to these brackets 20 and the tilt rams 25 acting to locate the grader blade in position.

A stabilizing ram 26 is provided to act between the rear of the turntable 2 and the frame member 7 to act across the rear of the turntable. The ram 26 can thus stabilize and also laterally displace the turntable assembly and grader blade to offset the blade as desired. Thus the whole movement of the frame is accommodated by the ball joint 6.

Also it is preferred that scrapers 27 be provided on the brackets 20 to act adjacent the rollers 21 to scrape away any dirt and the like which can accumulate on top of the upper turntable plate. As a plurality of rollers are used, the load is distributed between the rollers, so that the wear of the rollers on the plates and wear on the plates of the turntable themselves is minimised.

The forward end of the tractor on the extended chassis can house the tank 28 for the hydraulic fluid for the various hydraulic circuits with the hydraulic pump being driven by the tractor engine and the control valves being located in a convenient position to the operator.

By having the grader formed on a conventional tractor with an extended wheel base, the tractor is relatively manoeuvrable compared with existing conventional graders, and due to the large rear wheels and the ballast weights in and on these wheels the tractor is able to exert great digging and grading forces.

Thus it will be seen that there is provided according to the invention a grader which has adequate power and is relatively manoeuvrable for use in confined areas and although one form of the invention has been described in some detail it is to be realised that the invention is not to be limited thereto but can include various modifications falling within the spirit and scope of the invention.

I claim:

1. A grader comprising a tractor with an elongated chassis, said grader including a grader blade on a turntable, characterised in that said turntable comprises a lower plate to which the blade is attached, and a co-operating upper plate, said lower plate being supported by a plurality of spaced rollers engaging the lower surface of the lower plate, said rollers being mounted in brackets carried by said upper plate, said upper plate being supported by a frame universally mounted at its forward end to the forward portion of the tractor, and at its rearward end by a plurality of spaced lift rams acting between said turntable and support members fixed to said chassis, said frame at its forward end including a cross member, hydraulic rams for angling said blade extending from said cross member to further brackets on said blade, said further brackets for said angling rams extending upwardly and carrying rollers engaging the top surface of said upper plate, whereby operation of the angling rams causes relative rotation of the lower plate relative to the upper plate, scrapers being provided to deflect spoil from the upper plate in the path of said rollers as said lower plate rotates relative to the upper plate.

2. A grader as defined in claim 1, characterized in that said upper plate has a depending flange to protect the peripheral edge of said lower plate.

3. A grader as defined in claim 1, characterized by a transverse ram which extends from a rear portion of the upper plate to a fixed bracket on the chassis, whereby actuation of the transverse ram causes the turntable and blade to be displaced laterally of the chassis, the universal mounting and universal joints between the lift rams and the upper plate allowing this translative movement.

* * * * *